United States Patent [19]

Brockway

[11] Patent Number: 4,610,570

[45] Date of Patent: Sep. 9, 1986

[54] MARINE ANCHORS

[75] Inventor: Brian R. Brockway, Bournemouth, United Kingdom

[73] Assignee: Vickers Public Limited Company, London, United Kingdom

[21] Appl. No.: 794,383

[22] Filed: Nov. 4, 1985

[30] Foreign Application Priority Data

Nov. 27, 1984 [GB] United Kingdom ..... 8429920

[51] Int. Cl.[4] ..... E02D 5/74; B63B 21/50

[52] U.S. Cl. ..... 405/224; 114/294; 166/338; 405/195; 405/169

[58] Field of Search ..... 405/224, 195, 169, 170, 405/171; 166/338, 340; 114/293, 294, 295, 296, 297

[56] References Cited

U.S. PATENT DOCUMENTS 3,325,190 6/1967 Echert et al. ..... 166/338 X 3,840,071 10/1974 Baugh et al. ..... 166/338

4,405,263 9/1983 Hall ..... 114/294 X 4,432,670 2/1984 Lawson ..... 405/224

*Primary Examiner*—Dennis L Taylor

*Attorney, Agent, or Firm*—Shoemaker and Mattare, Ltd.

[57] ABSTRACT

In a marine anchor for coupling a tether to an anchoring chamber the tether terminates at a connector having a flange that abuts a flange of an anchoring chamber. A collet connector is expandible to trap flanges, in an external groove thereof, thereby establishing a primary load path. The mouth of the anchoring chamber is further provided with an out-turned flange engaged by locking fingers and operable by actuator means to establish a secondary load path from the anchoring chamber to the tether while the anchor is being established or released. The coupling can be separated without damage under high loads or when the tether is at an angle to the chamber.

10 Claims, 2 Drawing Figures

LOAD PATH
LOAD PATH
20
20

21
21

23'
32
22
32
31
27
33
23
24
25
25
41
26
26
12
40
15
42
11
44
13
30
45
43
10
46
36
35
33
34
51
50
LOAD PATH
LOAD PATH

MARINE ANCHORS

FIELD OF THE INVENTION

This invention relates to a coupling that may form part of a marine anchor system and that may be disconnected without damage under high or asymmetric loads.

BACKGROUND OF THE INVENTION

The coupling is intended for use in a single point mooring at the seabed, sea surface, or some intermediate position via a buoyant riser and is designed to allow a tanker with process facilities to stay on station connected to the single point mooring. In severe storm conditions the mooring system may be disconnected under load allowing the tanker to move off location to calmer areas. When conditions abate the tanker will return to location, reconnect the mooring and recommence production.

SUMMARY OF THE INVENTION

The invention also provides a coupling comprising first and second members having abutting flanges releasably engaged in a grooved collet connector to establish a primary load path, wherein the first member has an out-turned flange that, when said members are offered together, is surrounded by locking fingers of said second member that are operable by actuator means to engage said flange and establish a secondary load path between said members.

The invention further provides a coupling comprising first and second members to be releaseably connected and to release safely when under tensile load, abutting flanges of said first and second members, a collet having a groove into which said flanges engage to define a primary load path between said first and second members, an out-turned flange on one of said members, a plurality of locking fingers on the other of said members and surrounding said out-turned flange when said first and second members are offered together, and actuator means operable to engage said locking fingers with said out-turned flange, thereby establishing a secondary load path between said first and second members that is effective independent of whether said primary load path has been established. If the second member is connected to a tether line via universal joint means, the coupling can withstand cyclically varying asymmetric loads as from a moored vessel affected by wind and tide and can be released when the load deviates from its intended direction by angles up to 25°.

The invention yet further provides a coupling for anchoring an end of a tether, comprising an anchor chamber having at a mouth thereof an out-turned flange and an inturned flange, a connector for termination of the tether having a flange that abuts the inturned flange of the anchoring chamber, a collet having a groove into which said inturned flange and said connector flange lock to establish a primary load path from said anchoring chamber to said tether, locking fingers carried by said connector and surrounding the mouth of said anchoring chamber, and actuator means operable to engage said locking fingers with said out-turned flange, thereby establishing a secondary load path between said anchoring chamber and said tether that is effective when said coupling is being established or released.

DETAILED DESCRIPTION OF PREFERRED EMBODIMENT

Figures 1, 2:
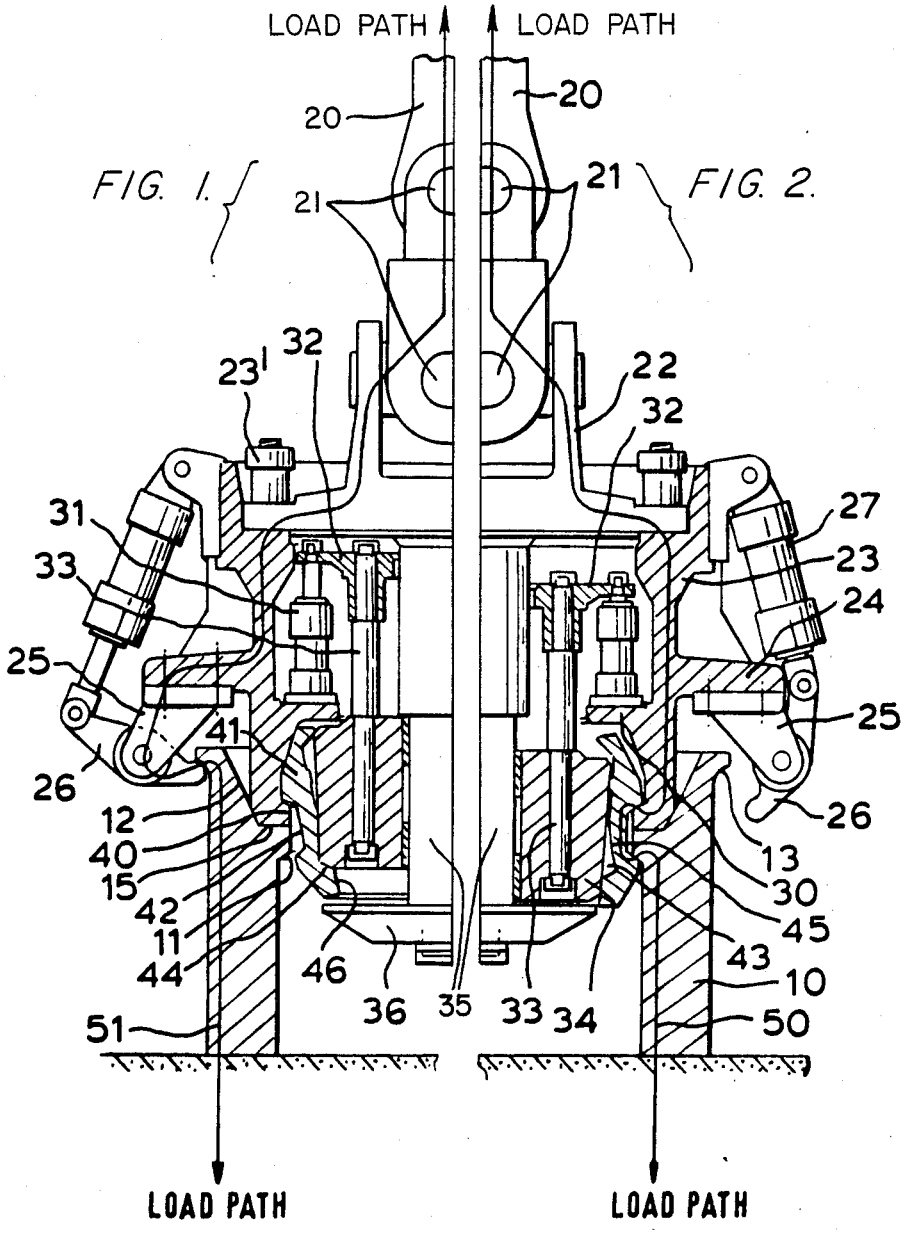
FIG. 1 is a section of a releaseable coupling according to the invention in its externally locked and internally unlocked state.
FIG. 2 is a section of a releaseable coupling according to the invention in its internally locked and externally unlocked state.

A permanent anchor base 10 on the seabed is of circular section and is formed with an internal flange 11 and a divergent mouth region 12 leading to an external flange 13. The top face of flange 11 is directed horizontally to define a seat 15.

A mooring tether line 20 is coupled by universal coupling 21 to a cast steel mooring attachment 22 fastened by studs and nuts 23' disposed in a ring to a cast steel housing 23 of circular section. Although the illustrated universal coupling 21 is via a Hookes joint, it will be understood that other forms of universal coupling such as a ball joint or a rubber and steel flexjoint as described in Specifications No. U.S. Pat. Nos. 4,320,993 and 4,459,933 may be employed. The housing 23 is formed with an external flange 24 whose lower face carries twenty bolted-on brackets 25 on which are fulcrumed clamp levers 26 that engage the lower face of the flange 13 as seen in view B. Actuators 27 pivoted between the housing 23 and the levers 26 engage and disengage the levers. The housing 23 is guided by the mouth region 12 and in the assembled coupling has its base region resting on the seat 15 as shown.

The housing 23 is internally flanged at 30 for attachment by their bases at equi-angular intervals of five actuators 31 whose rod ends are screwed to an annular crosshead 32 fastened by rods 33 to a sliding tapered plug 34. The plug 34 is also annular and is slideably guided by means of central column 35 depending from the mooring attachment 22. The column 35 carries at its lower end a shield 36 that serves to protect the plug 34 and other working parts from damage during insertion into and removal from the anchor base 10.

The housing 23 is formed with an inturned base flange 40 that serves to hold captive a segmented collet 41 formed with an external locking groove 42 permanently engaged by flange 40. The collet 41 retracts by upward movement of plug 34 so that an angular internal recess 43 defined by cam face 44 and stop face 45 engages therwith and expands by downward movement of the plug 34 whose end face traverses cam face 44 and to bring the side of the plug 34 into engagement with bearing face 46 as shown in View A. In the unexpanded state of the collet 41 (View B) the flange 11 is clear of the groove 42 so that the housing 23 is free to move vertically without interference but in the expanded state thereof the flange 11 is trapped within groove 42 between tapered upper and lower surfaces thereof so that there is a primary load path 50 from the anchor base 10 via flange 11 through collet 41 and flange 40 to the housing 23. The provision of the tapered surfaces applies a compressive pre-load between housing 23 and flange 11 that avoids fretting in service. There is a secondary load path 51 through flange 13, clamp levers 26, brackets 25 and flange 24 to housing 23.

To connect the coupling the housing 23 is lowered into the anchor base 10, the actuators 27 are operated to cause levers 26 to engage flange 13 to pull the mating surfaces together after which the initially extended double-acting actuators 31 are retracted to lower the plug 34 and expand the collet 41 thereby establishing primary load path 50. To release the coupling the now retracted actuators 27 are extended to engage levers 26 with flange 13 and establish the secondary load path 51, after which pressure is applied to actuators 31 to raise crosshead 32 and thereby plug 34. The segmented collet 41 now slides into its retracted state, thereby disabling load path 50. The twenty actuators 27 are now pressurised to retract levers 26 which free from flange 13 thereby freeing the housing 23 from the base 10.

The coupling described above has the advantages that (a) it can separate without damage and reconnect with ease even under high loads;

(b) it can separate at high angles;

(c) once initial contact between housing 23 and base 10 has been established the mating parts can be pulled fully home by actuators 27;

(d) the faces in the primary load path are not stressed during coupling and separation thereby minimising risk of damage;

(e) the levers 26 "roll" around flange 13 during separation which again minimises damage; and (f) all the actuators 27, 31 are retracted during normal service of the coupling thereby minimising their susceptibility to corrosion.

I claim:

1. A coupling for anchoring an end of a thether, comprising an anchor chamber having at a mouth thereof an out-turned flange and an inturned flange, a connector for termination of the tether having a flange that abuts the inturned flange of the anchoring chamber, a collet having a groove into which said inturned flange and said connector flange lock to establish a primary load path from said anchoring chamber to said tether, locking fingers carried by said connector and surrounding the mouth of said anchoring chamber, and actuator means operable to engage said locking fingers with said out-turned flange, thereby establishing a secondary load path between said anchoring chamber and said tether that is effective when said coupling is being established or released.

2. A coupling according to claim 1, wherein segments of said collet are expandible by a tapered internal locking plug to engage the abutting flanges of said connector and said anchoring chamber in a groove in the outer surface of the collet.

3. A coupling according to claim 2 wherein the locking plug is annular and is slideably guided on a column depending from said connector.

4. A coupling according to claim 3 wherein the lower end of the column carries a protective shield for the plug and collet.

5. A coupling according to claim 3, wherein the locking plug is operatively connected to an annular crosshead that fits onto the column and is actuated by a plurality of double-acting fluid operated actuators mounted on an internal flange of said connector.

6. A coupling according to claim 1, wherein the connector has an external flange whose lower face supports fulcrum brackets for the levers, each lever being operated by a fluid operated actuator pivoted between one end of the lever and the housing.

7. A coupling according claim 1, wherein a tapered guide surface of the anchor body leads inwardly and downwardly from adjacent the out-turned mouth flange to the in-turned flange that acts as an abutment for the base of the connector.

8. A coupling comprising first and second members to be releaseably connected and to release safely when under tensile load, abutting flanges of said first and second members, a collet having a groove into which said flanges engage to define a primary load path between said first and second members, and out-turned flange on one of said members, a plurality of locking fingers on the other of said members and surrounding said out-turned flange when said first and second members are offered together, and actuator means operable to engage said locking fingers with said out-turned flange, thereby establishing a secondary load path between said first and second members that is effective independent of whether said primary load path has been established.

9. A coupling comprising first and second members having abutting flanges releasably engaged in a grooved collet connector to establish a primary load path, wherein the first member has an out-turned flange that, when said members are offered together, is surrounded by locking fingers of said second member that are operable by actuator means to engage said flange and establish a secondary load path between said members.

10. A coupling according to claim 9 wherein the second member is connected to a tether line through universal joint means.

* * * * *